US006016936A

United States Patent [19]

Fan

[11] Patent Number: 6,016,936

[45] Date of Patent: Jan. 25, 2000

[54] LIQUID DISPENSER

[76] Inventor: Chen-Yueh Fan, Room F/23, 4th Fl., No. 5, Sec. 5, Hsinyi Rd., Taipei, Taiwan

[21] Appl. No.: 09/099,830

[22] Filed: Jun. 18, 1998

[51] Int. Cl.[7] ..... B67D 5/06

[52] U.S. Cl. ..... 222/181.1; 222/181.3; 222/341; 222/383.3; 222/514

[58] Field of Search ..... 222/181.1, 181.3, 222/340, 341, 380, 383.3, 385, 514

[56] References Cited

U.S. PATENT DOCUMENTS

| | | | |
|---|---|---|---|
| 2,529,365 | 11/1950 | Barksdale | 222/181.2 |
| 4,949,877 | 8/1990 | Hanna et al. | 222/341 |
| 4,972,978 | 11/1990 | DeLuca | 222/181.2 |
| 5,183,182 | 2/1993 | Comstock et al. | 222/181.2 |
| 5,605,256 | 2/1997 | Fan | 222/341 |
| 5,823,397 | 10/1998 | Gil | 222/181.3 |
| 5,842,609 | 12/1998 | Higgins | 222/181.3 |

*Primary Examiner*—Joseph A. Kaufman
*Attorney, Agent, or Firm*—Holland & Hart LLP

[57] ABSTRACT

A liquid dispenser having a hollow shaft slidably received therein and a hollow sleeve securely mounted therein and having the hollow shaft slidably inserted therethrough. The hollow shaft has a plurality of through holes defined therein and alternately communicating with one of the holes defined in the grill formed on the hollow sleeve. One of the holes communicates with a nozzle of the liquid dispenser, such that when one of the through holes is aligned and communicating with the hole, liquid received within the hollow shaft is then allowed to flow out from the nozzle.

5 Claims, 5 Drawing Sheets

LIQUID DISPENSER

BACKGROUND OF THE INOUTLETION

1. Field of the Invention

The present invention relates to a liquid dispenser, and more particularly to a liquid dispenser which has a hollow shaft axially movable within a receptacle for receiving a portion of liquid soap received within the receptacle and a hollow dispenser having a grill defined therein for allowing the liquid soap from the shaft to flow out from an outlet of the receptacle.

2. Background

Liquid dispensers are well known in the art and very popular all over the world. A U.S. Pat. No. 5,605,256 filed on Dec. 20, 1994 and issued to Fan discloses a fluid dispenser apparatus of the type.

Due to the convenience of the liquid dispenser, people are more and more attached to it. As one skilled in the art will appreciate that pushing inward a button toward a receptacle of the liquid dispenser will thus force the liquid soap received within the receptacle to flow out from an outlet of the receptacle. However, because the liquid soap has a certain degree of viscosity and a diameter of the shaft is slightly smaller than a diameter of the receptacle and also due to the shaft being made solid, pushing the button will become very difficult, since pushing the shaft will have to overcome the viscosity of the liquid soap. That is, because the conventional shaft of the liquid dispenser is made solid, pushing the shaft to force the liquid soap out from the outlet of the receptacle often causes a lot of trouble to the users, thus improvement and/or alternation thereof is necessary.

The present invention provides an improved liquid dispenser to obviate and/or mitigate the aforementioned problems.

SUMMARY OF THE INOUTLETION

The primary object of the invention is to provide an improved liquid dispenser which has a hollow shaft from which a user is able to easily force the liquid soap received within a receptacle of the dispenser out from an outlet.

Other novel features and advantages of the invention will become more apparent from the following detailed description when taken in conjunction with the accompanying drawings.

DETAILED DESCRIPTION OF THE PREFERRED EMBODIMENT

Figure 1:
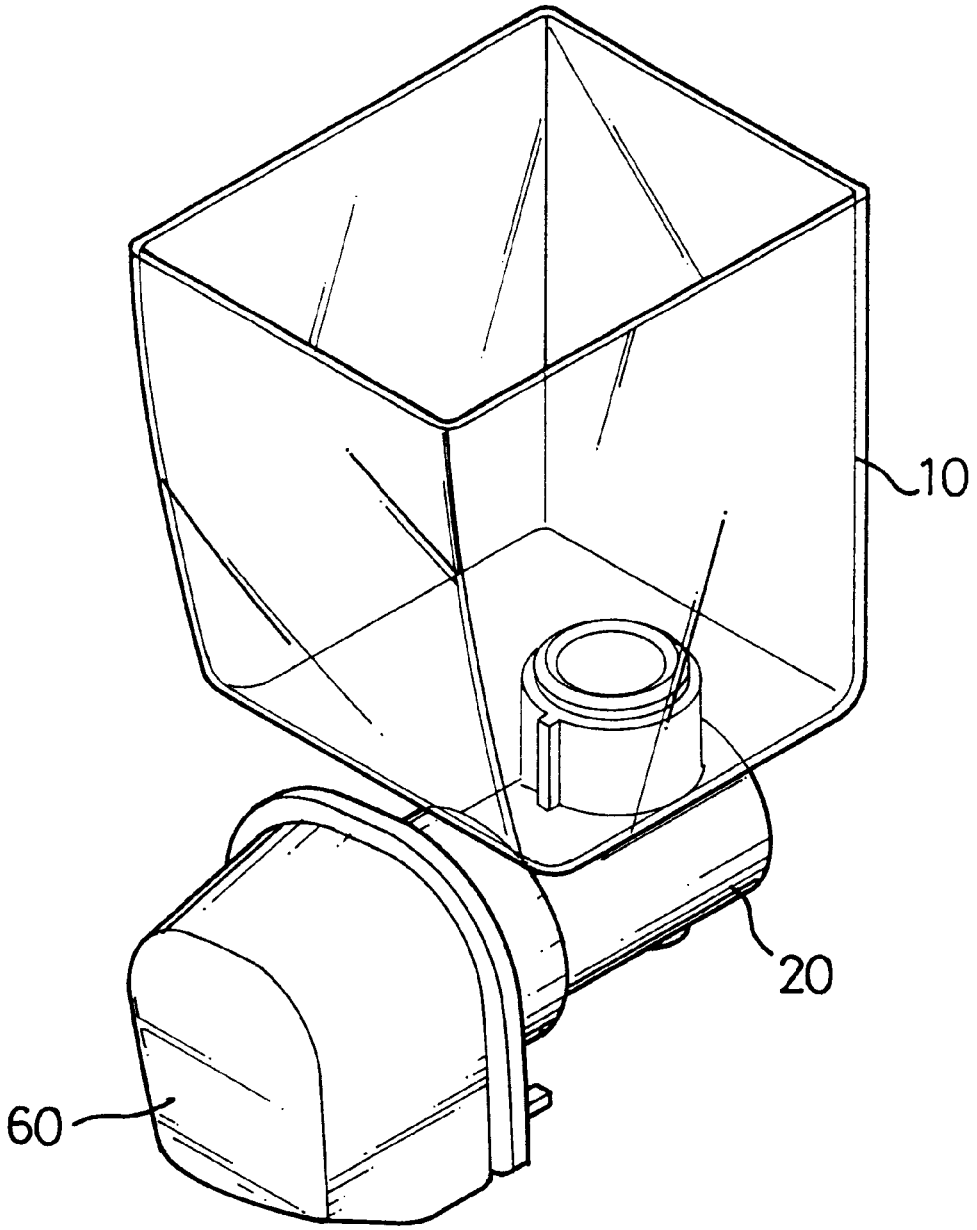
FIG. 1 is a perspective view of a preferred embodiment of a liquid dispenser of the present invention.
Figure 2:
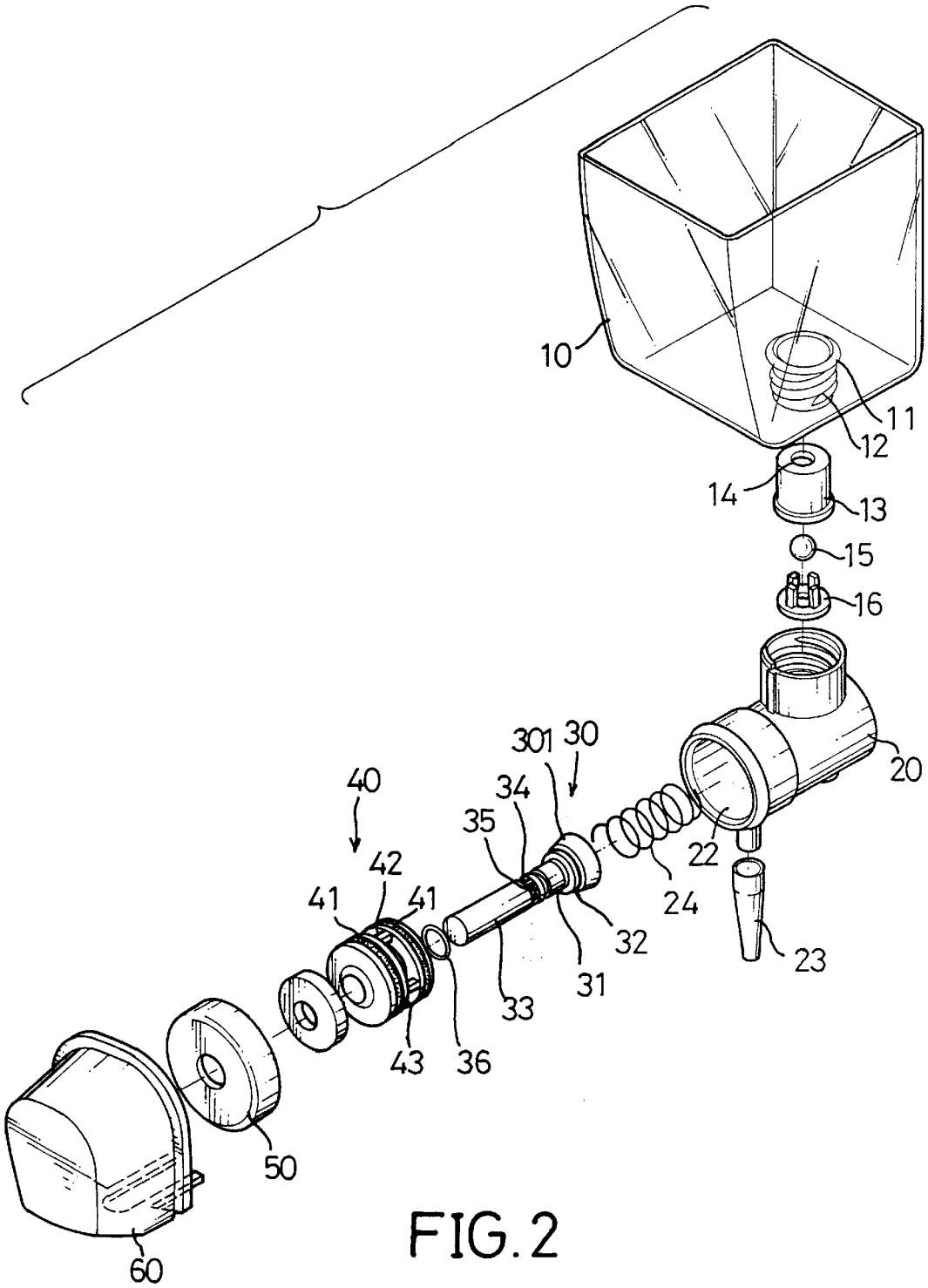
FIG. 2 is an exploded view of the liquid dispenser as shown in FIG. 1.

Referring to FIGS. 1 and 2, it is noted that a liquid dispenser constructed in accordance with the invention is shown. The liquid dispenser of the invention has a reservoir 10, a tubular receptacle 20 communicating with the reservoir

Figure 3:
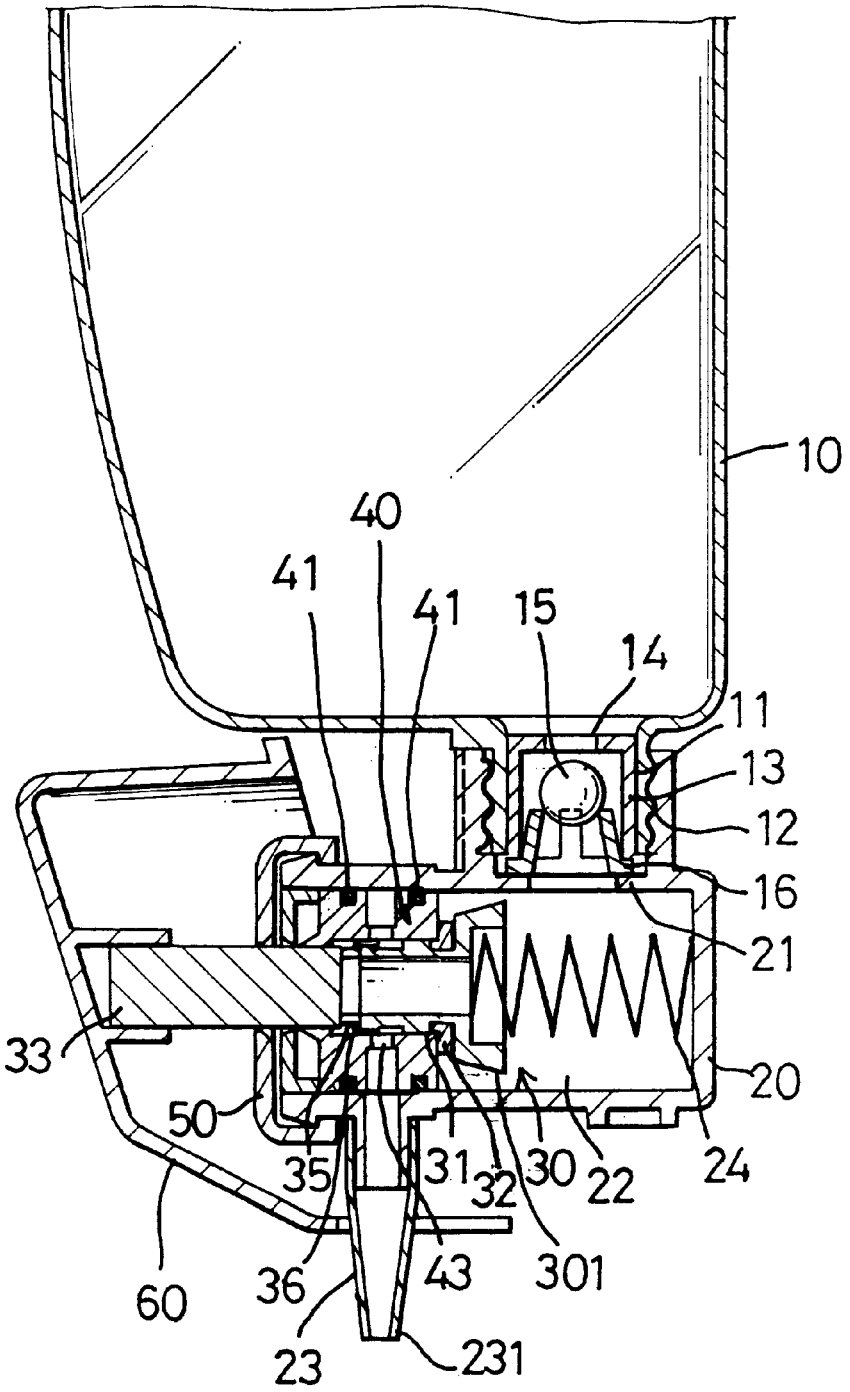
FIG. 3 is a schematic view showing a combination of the liquid dispenser of the invention.

10 and a button 60 detachably connected to the tubular receptacle 20. The reservoir 10 has an outlet 11 having threadings 12 formed on an outer periphery thereof. A tubular sleeve 13 for movably receiving therein a ball 15 has an opening 14 communicating with the outlet 11. A ball seat 16 is rested on a shoulder 21 (as shown in FIG. 3) formed with the tubular receptacle 20 when the tubular receptacle 20 is threadingly connected with the outlet 11. The tubular receptacle 20 has laterally defined therein a channel 22 communicating with the opening 14 of the tubular sleeve 13 and a nozzle 23 communicating with the channel 22. The tubular receptacle 20 is sealed on one end face (not shown) thereof, such that a coil spring 24 is able to be compressibly received between the sealed end face of the tubular receptacle 20 and a hollow shaft 30 when inserted into the channel 22 of the tubular receptacle 20. The hollow shaft 30 has a Y-shaped end 301 connecting with an end of the coil spring 24, a first portion 31 securely connected with the Y-shaped end 301, a second portion 33 securely connected with the first portion 31 via a plurality of ribs 34 laterally and securely disposed therebetween and a seal 32 detachably mounted on the first portion 31 to accomplish a water-tight seal between the hollow shaft 30 and an inner periphery of the tubular receptacle 20. Due to the provision of the ribs 34, a plurality of through holes 35 are defined to communicate with an internal space of the hollow shaft 30. A first O ring 36 is securely disposed onto the first portion 31 of the hollow shaft 30 and received within a hollow sleeve 40 to have a water-tight relationship between the hollow sleeve 40 and an outer periphery of the hollow shaft 30 when the hollow shaft 30 is slidably inserted into the hollow sleeve 40. The hollow sleeve 40 has two second O rings 41 spatially mounted thereto with respect to each other to ensure the liquid received within the tubular receptacle 20 does not leak out therefrom and a grill 42 laterally formed therewith such that a plurality of holes 43 are defined therein to communicate with the channel 22 and the nozzle 23 of the tubular receptacle 20 when received within the channel 22 of the tubular receptacle 20. It is to be noted that one of the two second O rings 41 is mounted to ensure that the liquid coming out from the holes 43 does not leak out from the hollow sleeve 40 in a direction where a button 60 is movably connected with respect to the tubular receptacle 20. Between the button 60 and the hollow sleeve 40, a plurality of secondary sleeves 50 are sequentially mounted onto the second portion 33 of the hollow shaft 30 to function as a cushion and facilitate the sealing effect of the O ring 41.

Figure 4:
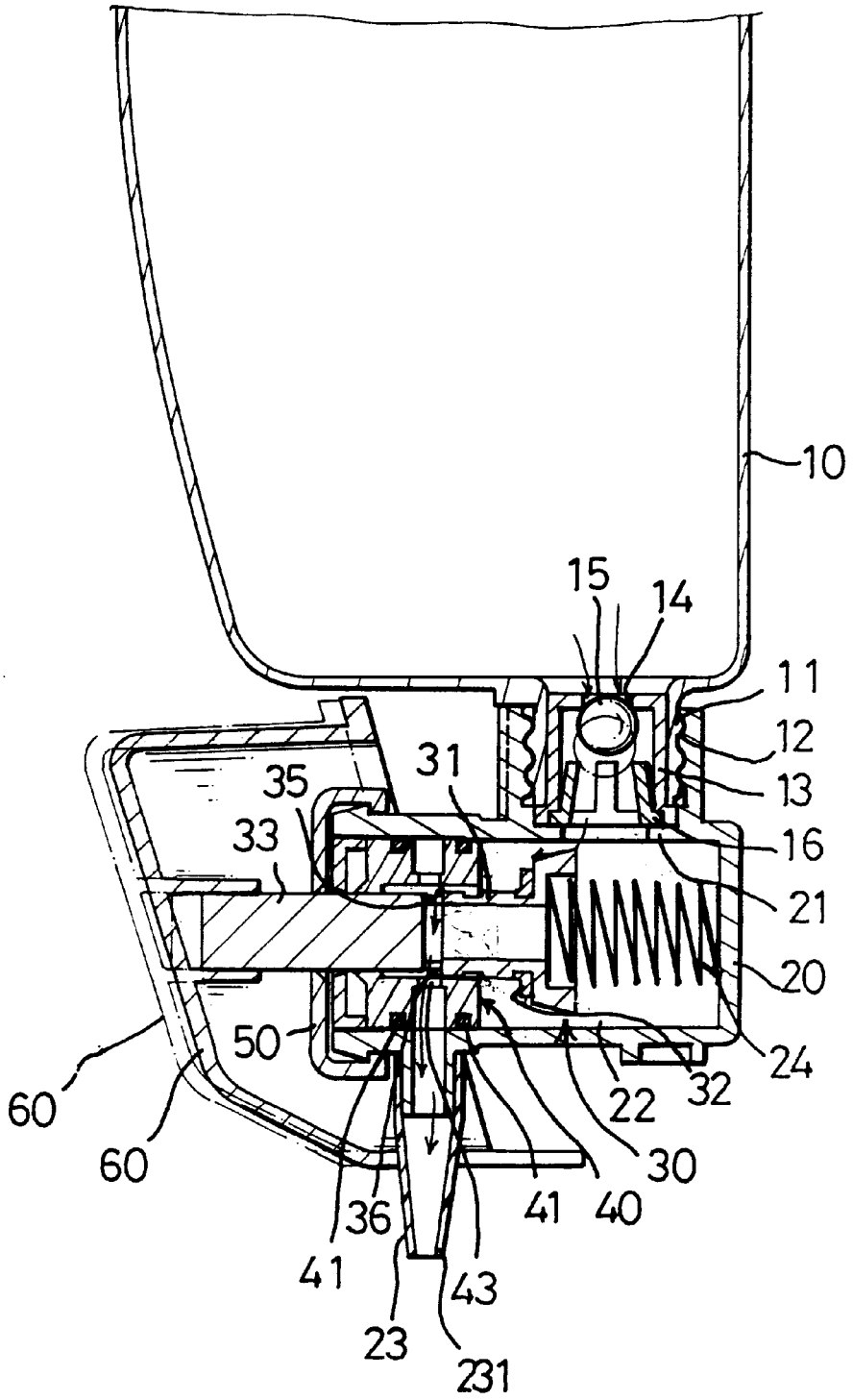
FIG. 4 is a schematic view showing a result caused by a movement of a button of the invention.

Referring to FIGS. 3 and 4, when the liquid dispenser of the inoutletion is assembled, as one skilled in the art will appreciate that the liquid received within the reservoir 10 will flow into the tubular receptacle 20 due to the effect of gravity via the outlet 11, the tubular sleeve 13 and the ball seat 16. The liquid received within the tubular receptacle 20, due to its viscosity and internal force, will not freely drip out from the nozzle 23. Furthermore, a free end 231 of the outlet 23 is cone shaped so that the liquid is further prevented from freely dripping out therefrom. The coil spring 24 is compressibly received between the end face of the tubular receptacle 20 and the Y-shaped end 301 of the hollow shaft 30, thus the coil spring 24 will provide the hollow shaft 30 a recovery force when compressed toward the end face of the tubular receptacle 20, as shown in FIG. 4. It is also noted that when the invention is assembled, the through holes 35 does not communicate with the hole 43 communicating with the nozzle 23. Thus, the liquid received within the tubular with receptacle 20 does not flow out. However, pushing the button 60 will drive the hollow shaft 30 to move respect to the end face of the tubular receptacle 20 and compress the coil spring 24. Because the shaft 30 is configured to be hollow, therefore, pushing the shaft 30 is much easier than the conventional one. When the through holes 35 are aligned with the holes 43 of the hollow sleeve 40 and communicating therewith, the liquid received within the tubular receptacle 20 will then begin to flow out of the nozzle 23. When the hollow shaft 30 is driven to move toward the end face of the tubular receptacle 20, the liquid received within the tubular receptacle 20, due to the non-compressible characteristic of fluid, will therefore force the ball 15 to move away from the ball seat 16 to close the hole 14 of the tubular sleeve 13 and prevent the liquid received within the reservoir 10 from flowing out therefrom.

Figure 5:
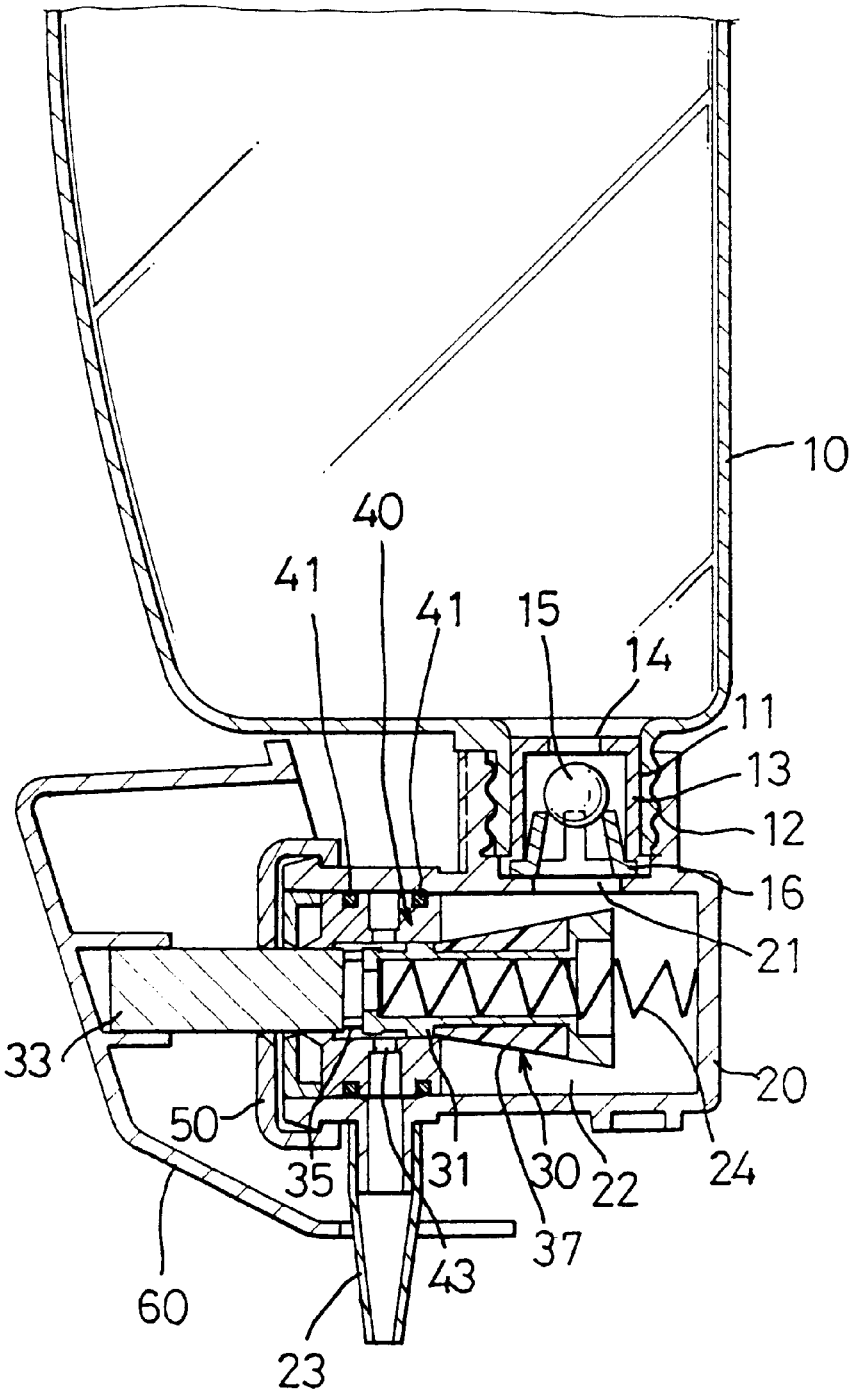
FIG. 5 is a schematic view showing another preferred embodiment of the invention.

Referring to FIG. 5, another preferred embodiment of the invention is shown, wherein most parts of the structure are the same as the first embodiment and bear the same reference numeral. The only difference between the first embodiment and the second embodiment is that the first embodiment is provided with the seal 32 and the first O ring 36, however, in the second embodiment the seal 32 and the first O ring 36 are combined into a seal 37 configured to have a cone shape, which is able to accomplish the same effect as the seal 32 and the first O ring 36.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid dispenser comprising a reservoir having an outlet defined therein and communicating therewith, a tubular sleeve securely received within the outlet and having a through hole defined to communicate with the reservoir, a ball movably received within the tubular sleeve and alternately sealing the through hole of the tubular sleeve, a tubular receptacle detachably connected with the outlet and having a ball seat received therein for seating the ball, a channel defined to communicate with the outlet and a nozzle communicating with the channel, a coil spring compressibly received within the channel for providing a recovery force to a driving arrangement securely connected thereto and a button movably connected with respect to the tubular receptacle, wherein the improvements are:

the driving arrangement comprises:

a hollow shaft movably received within the channel and having a Y-shaped end securely connected to the coil spring, a first portion formed with the Y-shaped end, a second portion and a plurality of ribs securely connected between the first portion and the second portion, whereby a plurality of through holes are defined therein for alternately dispensing the liquid received within the tubular receptacle;

a hollow sleeve securely mounted with respect to the tubular receptacle and having the hollow shaft slidably inserted therethrough, at least two sealing devices spaced apart from each other and mounted thereon and a grill defined between the two sealing devices, whereby a plurality of holes are defined therein and one of the holes are aligned with and communicate with the nozzle of the tubular receptacle.

2. The liquid dispenser as claimed in claim 1, wherein the hollow shaft further has a conical seal securely mounted thereon to prevent liquid from flowing out.

3. The liquid dispenser as claimed in claim 1, wherein the outlet has a conical free end.

4. The liquid dispenser as claimed in claim 1, wherein the grill is laterally formed on the hollow sleeve.

5. A liquid dispenser comprising a reservoir having an outlet defined therein and communicating therewith, a tubular sleeve securely received within the outlet and having a through hole defined to communicate with the reservoir, a ball movably received within the tubular sleeve and alternately seal the through hole of the tubular sleeve, a tubular receptacle detachably connected with the outlet and having a ball seat received therein for seating the ball, a channel defined to communicate with the outlet and a nozzle communicating with the channel, a coil spring compressibly received within the channel for providing a recovery force to a driving arrangement securely connected thereto and a button movably connected with respect to the tubular receptacle, wherein the improvements are:

the driving arrangement comprises:

a hollow shaft movably received within the channel and having a Y-shaped end securely connected to the coil spring, a conical seal mounted to the Y-shaped end, a first portion formed with the Y-shaped end, a second portion and a plurality of ribs securely connected between the first portion and the second portion, whereby a plurality of through holes are defined therein for alternately dispensing the liquid received within the tubular receptacle;

a hollow sleeve securely mounted with respect to the tubular receptacle and having the hollow shaft slidably inserted therethrough, at least two sealing devices spaced apart from each other and mounted thereon and a grill laterally defined between the two sealing devices, whereby a plurality of holes are defined therein and one of the holes are aligned with and communicate with the nozzle of the tubular receptacle.

* * * * *